US008689937B2

(12) United States Patent
Grado

(10) Patent No.: US 8,689,937 B2
(45) Date of Patent: Apr. 8, 2014

(54) CARGO LIFTING DEVICE FOR A LADDER

(76) Inventor: Gilberto M. Grado, El Paso, TX (US)

( * ) Notice: Subject to any disclaimer, the term of this patent is extended or adjusted under 35 U.S.C. 154(b) by 136 days.

(21) Appl. No.: 13/236,846

(22) Filed: Sep. 20, 2011

(65) Prior Publication Data

US 2013/0068559 A1 Mar. 21, 2013

(51) Int. Cl.
*E06C 7/16* (2006.01)

(52) U.S. Cl.
CPC ..... *E06C 7/16* (2013.01)
USPC ..... 182/101; 182/102; 182/103

(58) Field of Classification Search
USPC ..... 182/101, 102, 103
See application file for complete search history.

(56) References Cited

U.S. PATENT DOCUMENTS

| | | | | | |
|---|---|---|---|---|---|
| 107,225 | A | * | 9/1870 | Clafin | 182/103 |
| 444,280 | A | * | 1/1891 | Pepin | 182/103 |
| 570,939 | A | * | 11/1896 | Mack | 182/102 |
| 683,890 | A | * | 10/1901 | Wolfe | 187/262 |
| 976,240 | A | * | 11/1910 | Winkler | 182/103 |
| 1,794,175 | A | * | 2/1931 | Honig | 182/103 |
| 1,924,751 | A | * | 8/1933 | Porter | 182/68.3 |
| 1,969,628 | A | * | 8/1934 | Skeenes | 182/14 |
| 2,249,900 | A | * | 7/1941 | Honig | 182/68.3 |
| 2,312,833 | A | * | 3/1943 | Graham | 182/102 |
| 2,394,148 | A | * | 2/1946 | Campbell | 414/598 |
| 2,714,434 | A | * | 8/1955 | Peterson | 477/170 |
| 3,081,839 | A | * | 3/1963 | O'Brien | 182/103 |
| 3,115,211 | A | * | 12/1963 | Ostrander, Jr. | 182/103 |
| 3,237,719 | A | * | 3/1966 | Russell | 182/103 |
| 3,428,145 | A | * | 2/1969 | Lyon | 182/103 |
| 3,476,212 | A | * | 11/1969 | Eakins | 182/103 |
| 3,592,294 | A | * | 7/1971 | Allen | 187/241 |
| 3,891,062 | A | * | 6/1975 | Geneste | 187/245 |
| 3,910,378 | A | * | 10/1975 | Nyman | 182/103 |
| 4,183,423 | A | | 1/1980 | Lewis | |
| 4,491,196 | A | * | 1/1985 | Bocker | 187/243 |
| 4,930,599 | A | * | 6/1990 | Simms, Sr. | 182/103 |
| 5,590,739 | A | * | 1/1997 | High et al. | 182/169 |
| 6,244,381 | B1 | | 6/2001 | Ruble | |
| 6,527,088 | B1 | | 3/2003 | Fowler | |
| 6,533,070 | B1 | | 3/2003 | Elrod | |
| 6,981,573 | B2 | | 1/2006 | Nickel | |
| 7,255,198 | B1 | * | 8/2007 | Lo | 182/172 |
| 7,900,745 | B1 | * | 3/2011 | Tindal | 182/103 |
| 2002/0043426 | A1 | * | 4/2002 | Bruneau et al. | 182/103 |

* cited by examiner

*Primary Examiner* — Alvin Chin Shue
*Assistant Examiner* — Colleen M Chavchavadze
(74) *Attorney, Agent, or Firm* — Dale J. Ream

(57) ABSTRACT

A cargo lifting apparatus for use with a ladder includes a lift track coupled to each ladder side rail. Each lift track includes first and second adjacent channels, the first channel defining a longitudinal slot. The apparatus includes a carrier assembly having a back portion, a pair of support members extending perpendicularly and forwardly from the back portion, opposed mounting members configured to be received in a respective first channel slot, and rollers attached to the back portion configured to bear against respective ladder side rails. A motor/brake combination is coupled to a lower rung of the ladder. A pulley assembly includes a lower sprocket operatively coupled to the motor, an upper sprocket, and a cord extending between the sprockets and coupled to the carrier assembly for selectively raising and lowering the carrier assembly when the motor is activated or deactivated.

18 Claims, 12 Drawing Sheets

CARGO LIFTING DEVICE FOR A LADDER

BACKGROUND OF THE INVENTION

This invention relates generally to cargo lifting devices and, more particularly, to a cargo lifting device for use with a ladder of the type having parallel rails and a plurality of rungs extending between rails.

Ladders are typically utilized by roofers, painters, or the like to bring shingles, paint, or other materials to the roof of a structure or other heightened location for use. Carrying heavy materials like shingles up a ladder is a dangerous proposition in that carrying such materials may require the use of both hands, leaving little ability of the workman to hang on to the rungs or rails of the ladder. In addition, manually carrying multiple packages of shingles, tools, or perhaps beverages is likely to require multiple trips up and down the ladder, increasing the dangerousness of the task.

Although various devices having been proposed in the art for lifting cargo in cooperation with a ladder, the existing devices do not provide a cargo assembly slidably operated on a pulley assembly controlled by a combination motor/brake and with a backup inertia reel safety device.

Therefore, it would be desirable to have a cargo lifting apparatus that overcomes the limitations of the prior art and provides a safe and user friendly apparatus for transporting cargo between a ground surface and upward structure such as the roof of a house.

SUMMARY OF THE INVENTION

A cargo lifting apparatus for use with a ladder according to a preferred embodiment of the present invention includes a life track coupled to each ladder side rail. Each lift track includes first and second adjacent channels, the first channel defining a longitudinal slot. The apparatus includes a carrier assembly having a back portion, a pair of support members extending perpendicularly and forwardly from the back portion, opposed mounting members configured to be received in a respective first channel slot, and rollers attached to the back portion configured to bear against respective ladder side rails. A motor/brake combination is coupled to a lower rung of the ladder. A pulley assembly includes a lower sprocket operatively coupled to the motor, an upper sprocket, and a cord extending between the sprockets and coupled to the carrier assembly for selectively raising and lowering the carrier assembly when the motor is activated or deactivated, respectively.

Therefore, a general object of this invention is to provide a cargo lifting apparatus for use with a ladder that is configured to selectively hoist construction materials up or down the ladder.

Another object of this invention is to provide a cargo lifting apparatus, as aforesaid, that utilizes a pulley assembly and motor to selectively actuate movement of a carrier assembly to move up or down the rails of the ladder.

Still another object of this invention is to provide a cargo lifting apparatus, as aforesaid, having a lift track coupled to each ladder rail having first and second channels, one of which defines a slot.

Yet another object of this invention is to provide a cargo lifting apparatus, as aforesaid, that includes a cargo carrier assembly having mounting members received in the channel slot for slidable movement therealong when the motor is activated, thereby raising or lowering cargo that is supported on the carrier assembly.

A further object of this invention is to provide a cargo lifting apparatus, as aforesaid, having a safety reel configured to prevent the carrier assembly from falling in the event of a failure of the motor/brake unit.

A still further object of this invention is to provide a cargo lifting apparatus, that is easy to use and economical to manufacture.

Other objects and advantages of the present invention will become apparent from the following description taken in connection with the accompanying drawings, wherein is set forth by way of illustration and example, embodiments of this invention.

DESCRIPTION OF THE PREFERRED EMBODIMENT

Figure 1:
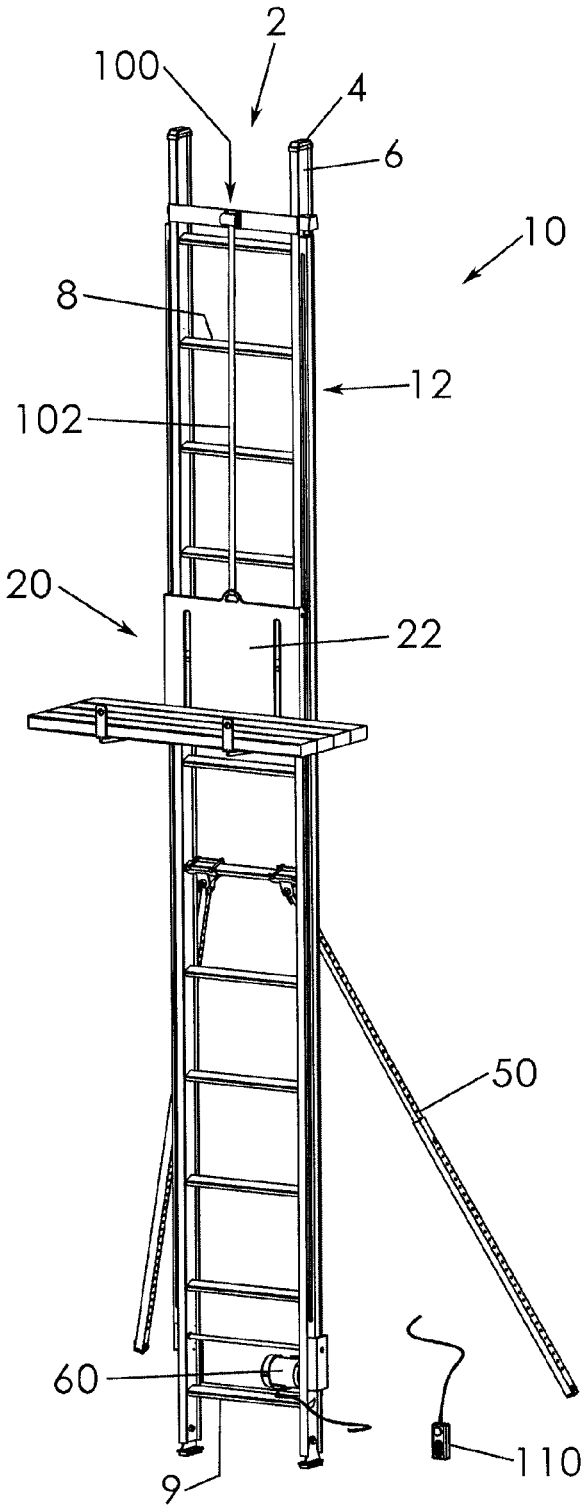
FIG. 1 is a perspective view of a cargo lifting apparatus according to a preferred embodiment of the present invention.
Figure 2:
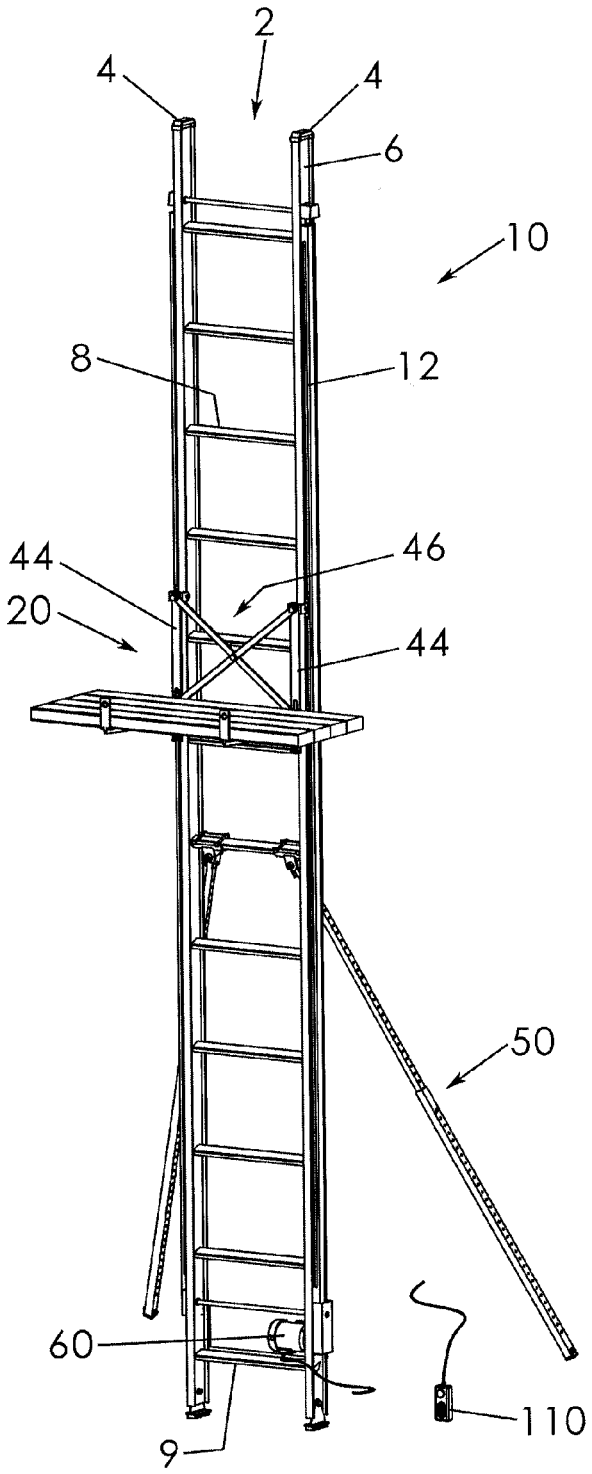
FIG. 2 is another perspective view of a cargo lifting apparatus with the carrier assembly back portion removed.
Figure 3:
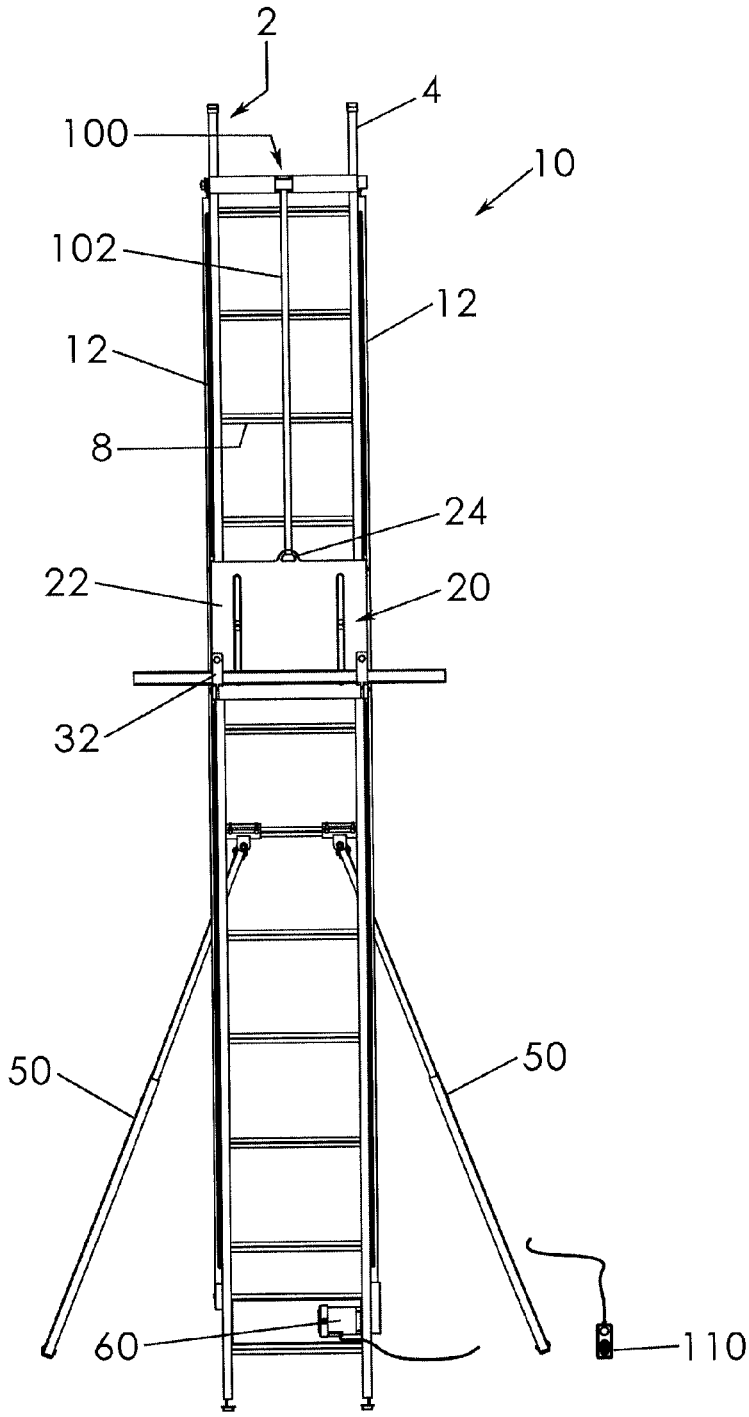
FIG. 3 is a front view of the cargo lifting apparatus as in FIG. 1.

A cargo lifting apparatus 10 for use with a ladder 2 of a type having opposed parallel rails 4 and a plurality of rungs 8 connecting the ladder rails 4 will now be described with reference to FIGS. 1 to 12 of the accompanying drawings. The lifting apparatus 10 includes a pair of lift tracks 12, first 14 and second 16 channels in each lift track 12, a carrier assembly 20 operatively coupled to respective lift tracks 12 for movement therealong, a motor/brake 60 combination coupled to the ladder 2, and a pulley assembly connecting the motor/brake 60 with the carrier assembly 20.

Figure 4A:
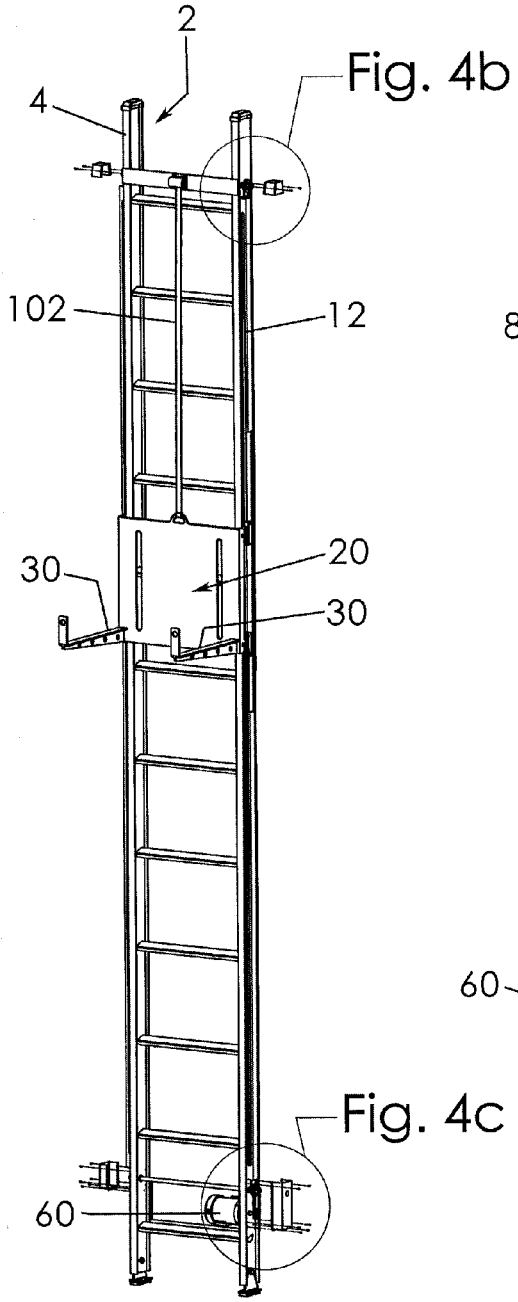
FIG. 4*a* is another perspective view of the cargo lifting apparatus as in FIG. 1.
Figure 4B:
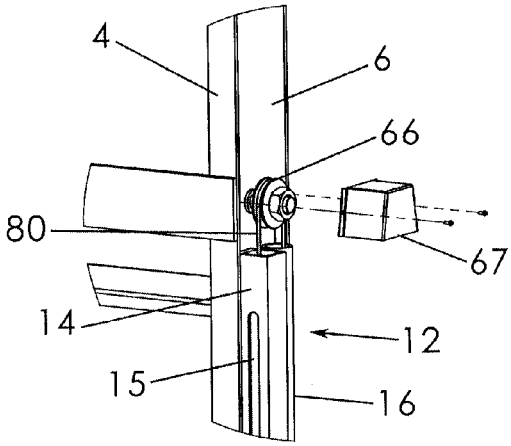
FIG. 4*b* is an isolated view on an enlarged scale taken from FIG. 4*a;*
Figure 4C:
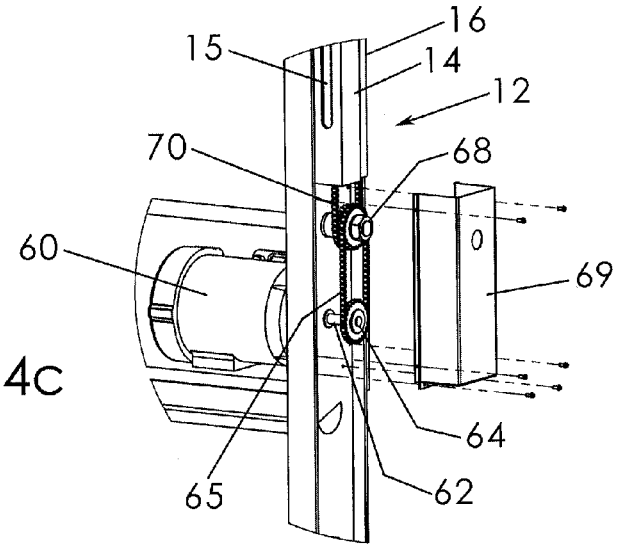
FIG. 4*c* is an isolated view on an enlarged scale taken from FIG. 4*a;*

As shown in FIGS. 4*a* to 4*c*, each lift track 12 is coupled to an outer surface 6 of a respective side rail 4 of the ladder 2. It is understood that the outer surface 6 of a side rail may have a generally planar configuration to which an inner surface of a lift track 12 is complementary. More particularly, each lift track 12 includes first 14 and second 16 channels situated adjacent one another. Each channel includes a tubular configuration defining an interior space and open bottom and top ends such cords from a pulley assembly 90 may extend therethrough as will be discussed in more detail later.

Preferably, a pair of guide members 18 are positioned in the interior area of each first channel 14 although it may possible for only a single guide member 18 to be used. Each guide member 18 is configured to be movable along the inside of the first channel 14 as will be understood below. Preferably, the guide members 18 are constructed of a hard plastic or composite material and may include filleted edges so as to minimize friction when slidably moved within the interior areas of the channels.

Figure 8A:
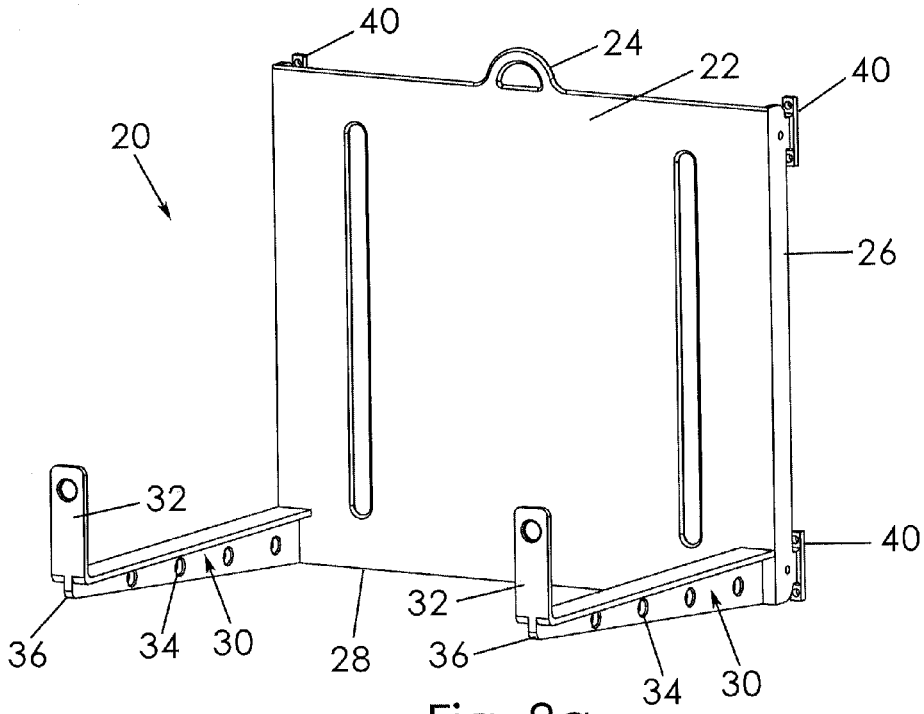
FIG. 8*a* is a front perspective view of a carrier assembly removed from the cargo lifting apparatus of FIG. 8*a;*
Figure 8B:
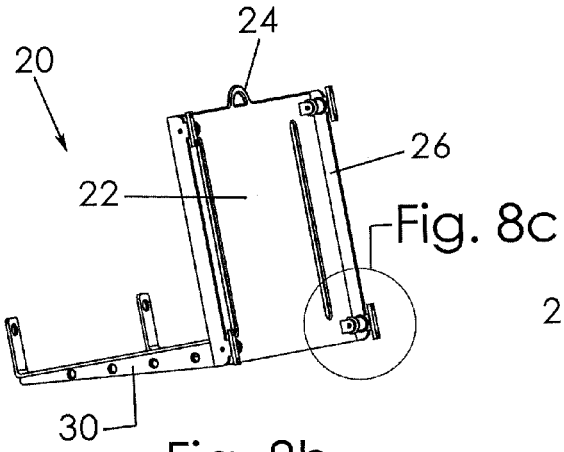
FIG. 8*b* is a rear perspective view of the carrier assembly as in FIG. 8*a;*
Figure 8C:
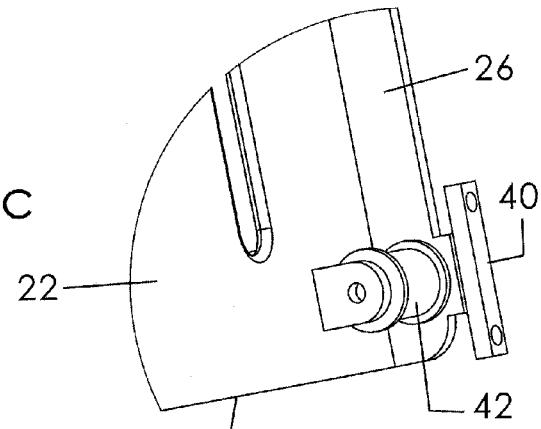
FIG. 8*c* is an isolated view on an enlarged scale taken from FIG. 8*b;*
Figure 9A:
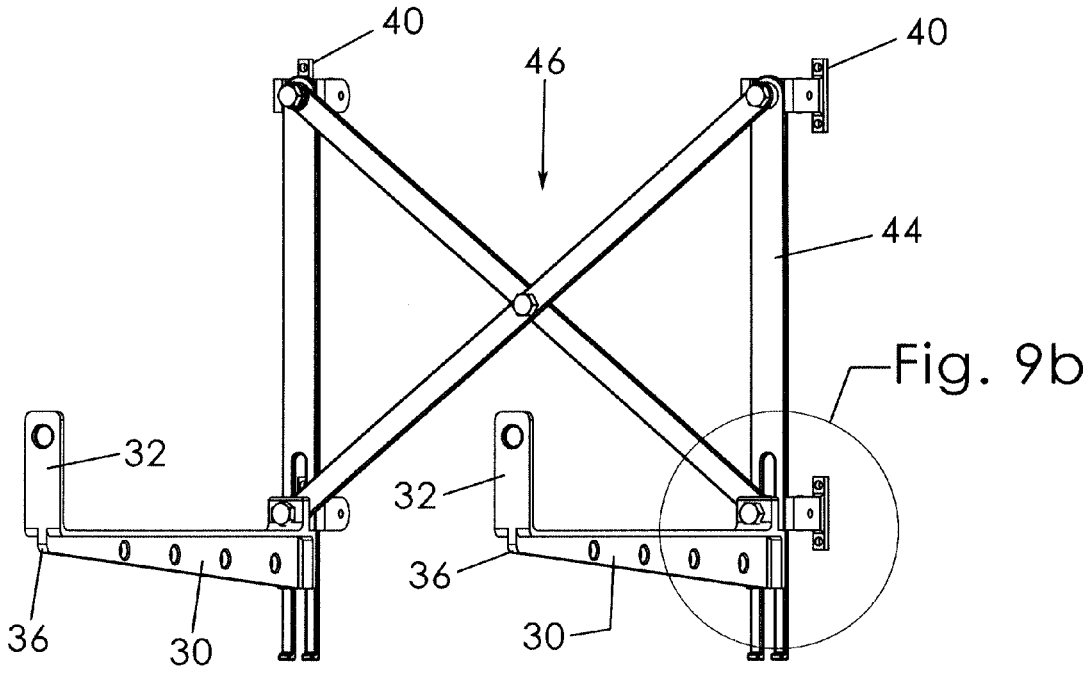
FIG. 9*a* is a rear perspective view of a carrier assembly according to an alternative embodiment of the cargo lifting apparatus.
Figure 9B:
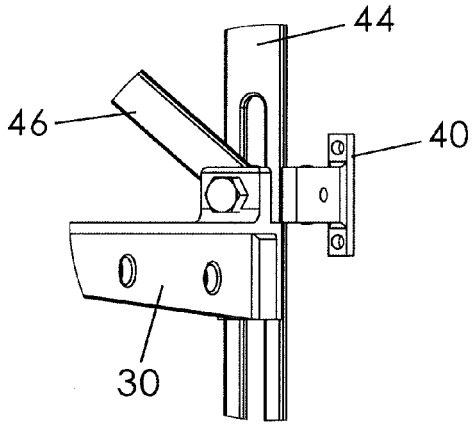
FIG. 9*b* is an isolated view on an enlarged scale taken from FIG. 9*a;*
Figure 10A:
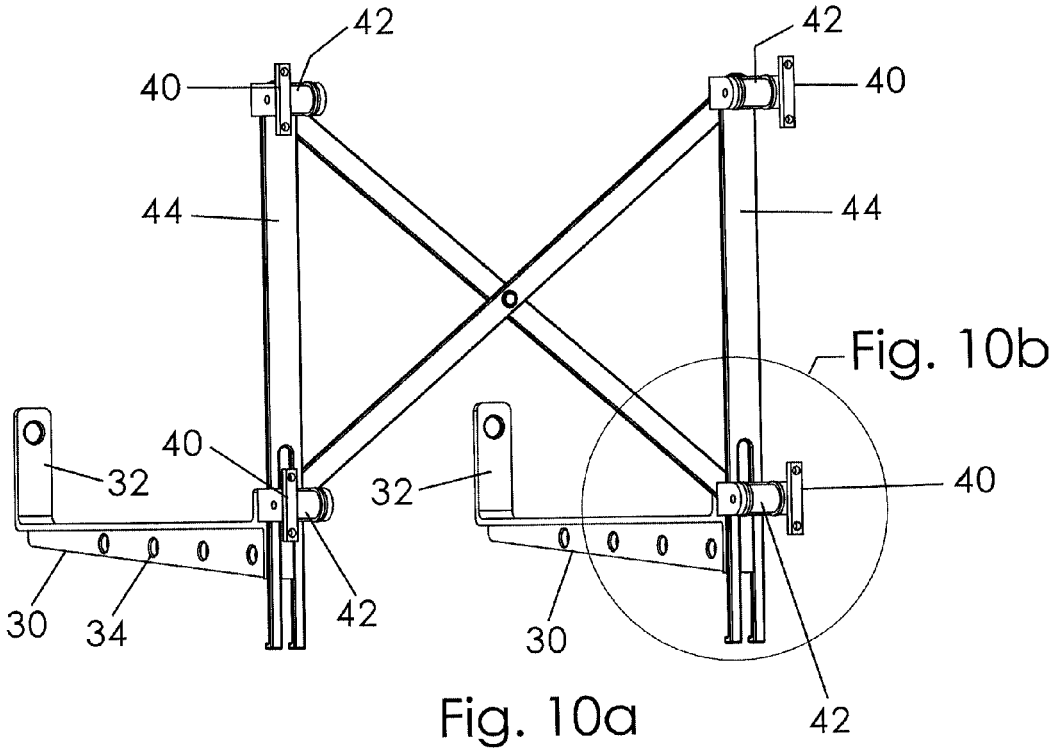
FIG. 10*a* is another rear perspective view of a carrier assembly as in FIG. 9*a;*
Figure 10B:
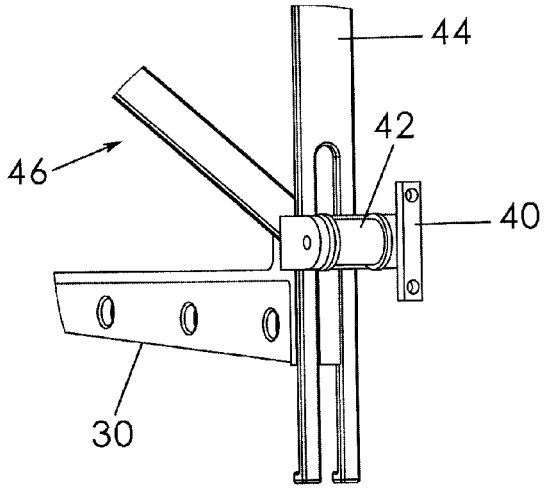
FIG. 10*b* is an isolated view on an enlarged scale taken from FIG. 10*a;*

The carrier assembly 20 includes a back portion 22. At least one support member 30 is coupled to the back portion 22 adjacent a lower edge 28 thereof and extends forwardly away from the back portion 22 (FIG. 8*a*). Preferably, the at least one support member 30 is generally perpendicular to the back portion 22. The support member 30 may include a lip 32 extending upwardly from a distal end 36 relative to the back portion 22 that is configured to prevent cargo supported on the support member 30 from sliding off the support member 30. The lip 32, therefore, may be generally parallel to and displaced from the back portion 22 of the carrier assembly 20. The at least one support member 30 may be a platform. Alternatively, the at least one support member 30 may be two or more support members 30 opposed to or otherwise spaced apart from one another (FIG. 8*a*). Each support member 30 may define a plurality of spaced apart apertures 34 configured to enable accessories, such as tools or other materials, to be tied or otherwise coupled to the support member 30.

Figure 7A:
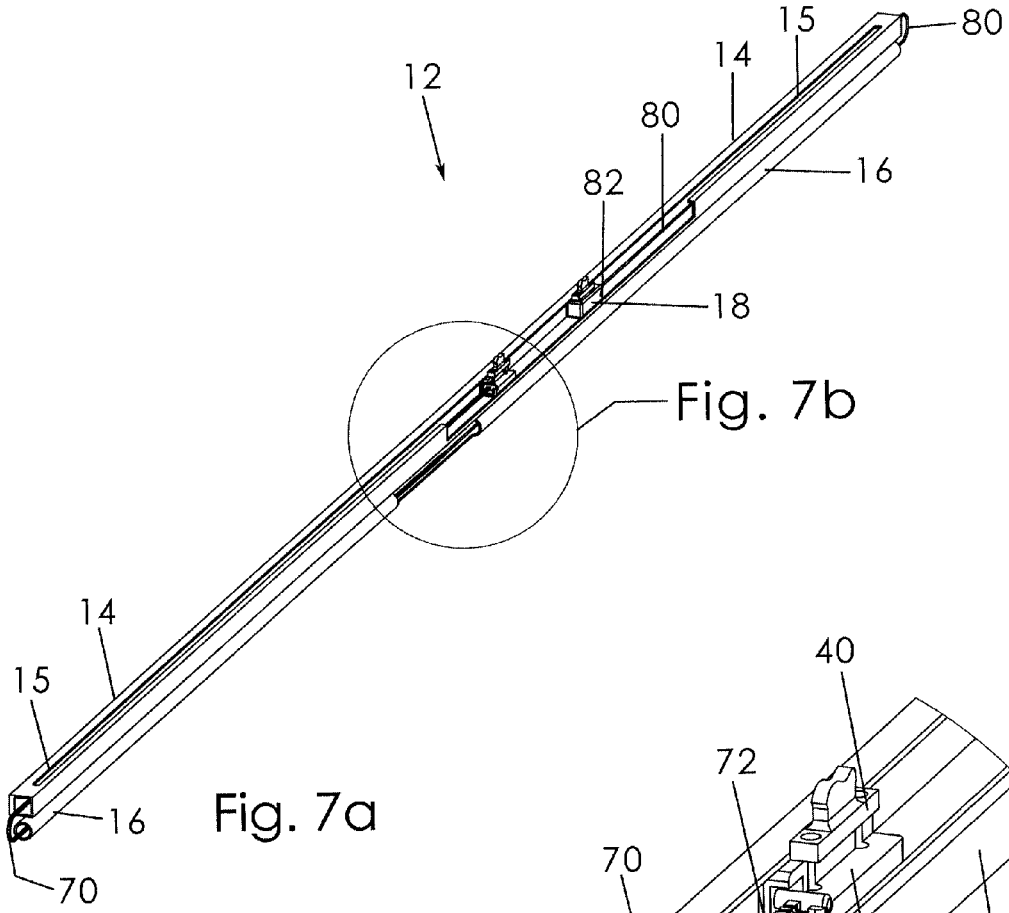
FIG. 7*a* is a perspective view of a lift track removed from the cargo lifting apparatus of FIG. 1.
Figure 7B:
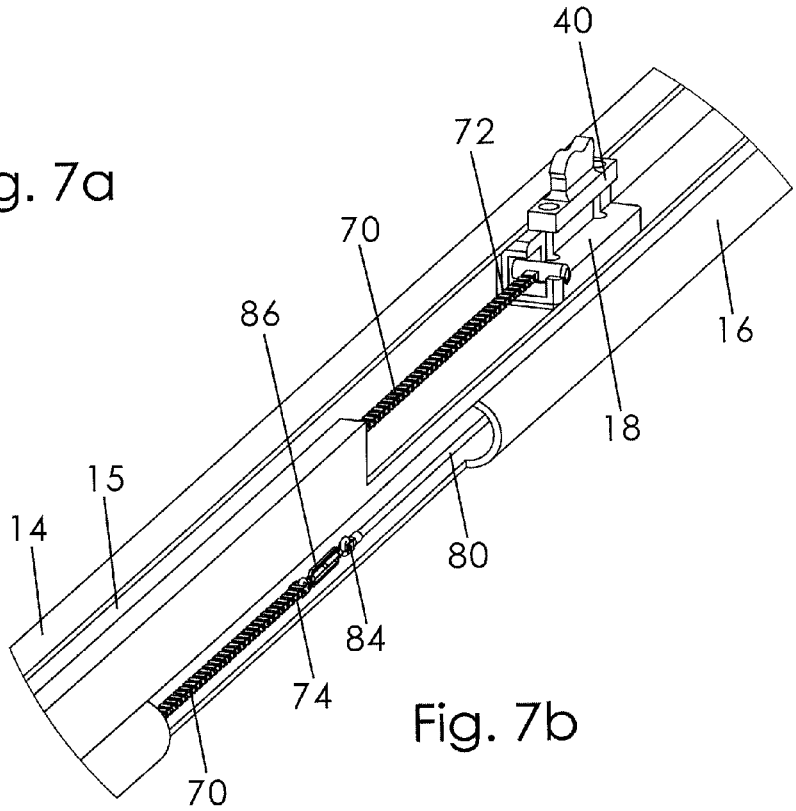
FIG. 7*b* is an isolated view on an enlarged scale taken from FIG. 7*a;*

The carrier assembly 20 includes at least one mounting member 40 configured to attach slidably to a lift track 12. Preferably, however, the carrier assembly 20 includes a pair of mounting members 40. Each mounting member 40 may be attached to a side edge 26 of the back portion 22 and configured to be received in the slot 15 of a respective first channel 14. Each mounting member 40 may be construed as having "feet" configured to be inserted into a respective first channel slot 15. The foot or mounting member 40 is coupled to a respective slidable guide member 18 that is positioned in a first channel (FIG. 7*b*). Therefore, each carrier assembly 20 is operatively coupled to the pulley assembly 90 by connection to a respective mounting member 40 and slidable guide member 18.

At least a pair of rollers 42 is attached to the back portion 22 of the carrier assembly 20 and configured to bear against a respective ladder rail 4 when the mounting members 40 are received in respective first channel slots 15, the rollers being configured to enable the carrier assembly to roll smoothly along the ladder rails.

With reference again to the back portion 22, the back portion 22 may be a plate having a generally planar configuration that is generally perpendicular to the support member (s). Alternatively to the back portion 22 including a planar plate, the back portion 22 may include a pair of upstanding mounting rails 44 and a scissor mechanism 46 operatively coupled between the pair of mounting rails. The mounting rails 44 are configured for movement between collapsed and expanded configurations such that a distance between the mounting rails is increased when the scissor mechanism is moved toward the expanded configuration and is decreased when the scissor mechanism is moved toward the collapsed configuration.

The pulley assembly 90 includes a lower sprocket 68 rotatably coupled to a respective ladder side rail 4 below a respective lift track 12 and operatively connected to the motor/brake 60. As shown in FIG. 5*c*, the lower sprocket 68 may be connected to a motor output shaft 62 with a gear train 64 having one or more gears and a gear train chain 69 configured such that operation of the motor/brake 60 operates the output shaft 62, gear train 64, and lower sprocket 68. The lower sprocket 68 is positioned below a lower end of the lift track 12.

A chain 70 is operatively coupled to the lower sprocket 68 and includes a first end 72 extending upwardly into the interior area of the first channel 14 and a second end 74 extending upwardly into the interior area of the second channel 16. The pulley assembly 90 includes an upper sprocket 66 rotatably coupled to the same ladder side rail 4 as is coupled to the lower sprocket 68. The upper sprocket 66 is positioned above the respective lift track 12 connected to that side rail 4. The pulley assembly 90 includes a cable 80 operatively coupled for movement about the upper sprocket 66 that includes a cable first end 82 extending downwardly into the interior area of the first channel 14 and a cable second end 84 extending downwardly into the interior area of the second channel 16.

The chain first end 72 is coupled to a guide member 18 situated in the first channel 14 and that is coupled to a mounting member 40 of the carrier assembly 20 (FIG. 7*b*). The cable first end 82 may be coupled to another guide member 18 situated in the first channel 14 and which is operatively connected to the carrier assembly 20. Therefore, coordinated movement of the chain 70 and cable 80 cause the carrier assembly 20 to move upwardly or downwardly along the lift tracks 12 as respective guide members 18 are slidably moved within the lift tracks 12. It is understood that the chain 70 and cable 80 may together be referred to as a cord. In addition, a tensioning device 86 may be situated intermediate the cable second end 84 and chain second end 74 so as to maintain cord alignment and sprocket engagement.

The combination motor/brake 60 may be attached to a lower rung 9 of the ladder 2. The motor/brake 60 includes an output shaft 62 operatively connected to the pulley assembly 90 by way of the gear train 64 and gear train chain 69 described above. It is understood that when the motor/brake 60 is electrically activated, the lower sprocket 68 is rotated causing movement of the chain 70 and consequent movement of the carrier assembly 20. The brake component of the motor 60 is configured to stop free spinning of the motor when the motor is electrically deactivated such that movement of the pulley assembly 90 and carrier assembly 20 are also halted from any further movement.

Figure 11A:
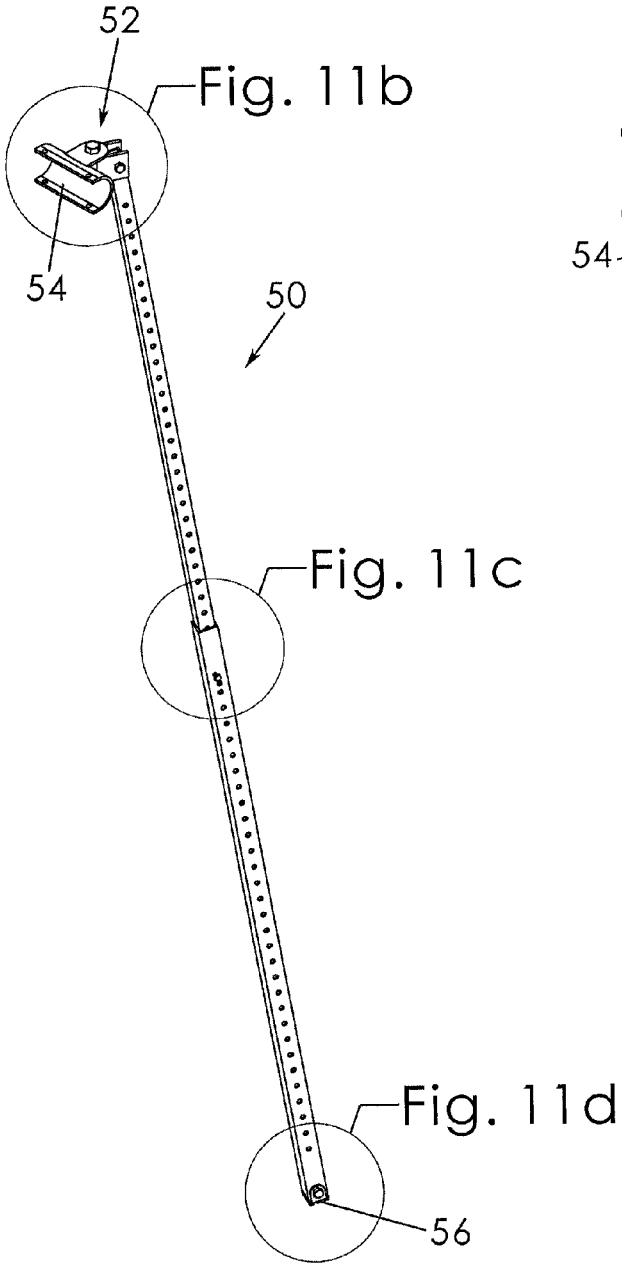
FIG. 11*a* is a perspective view of a brace member removed from the cargo lifting apparatus of FIG. 1.
Figure 11B:
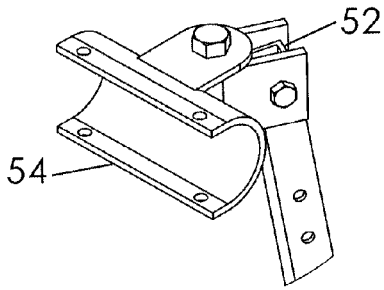
FIG. 11*b* is an isolated view on an enlarged scale taken from FIG. 11*a;*
Figure 11C:
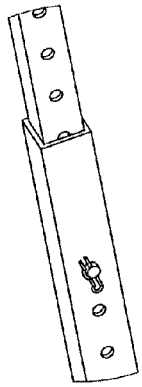
FIG. 11*c* is an isolated view on an enlarged scale taken from FIG. 11*a;*
Figure 11D:
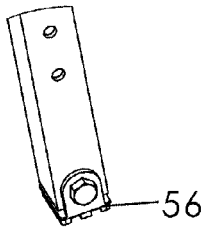
FIG. 11*d* is an isolated view on an enlarged scale taken from FIG. 11*a*.
Figure 12:
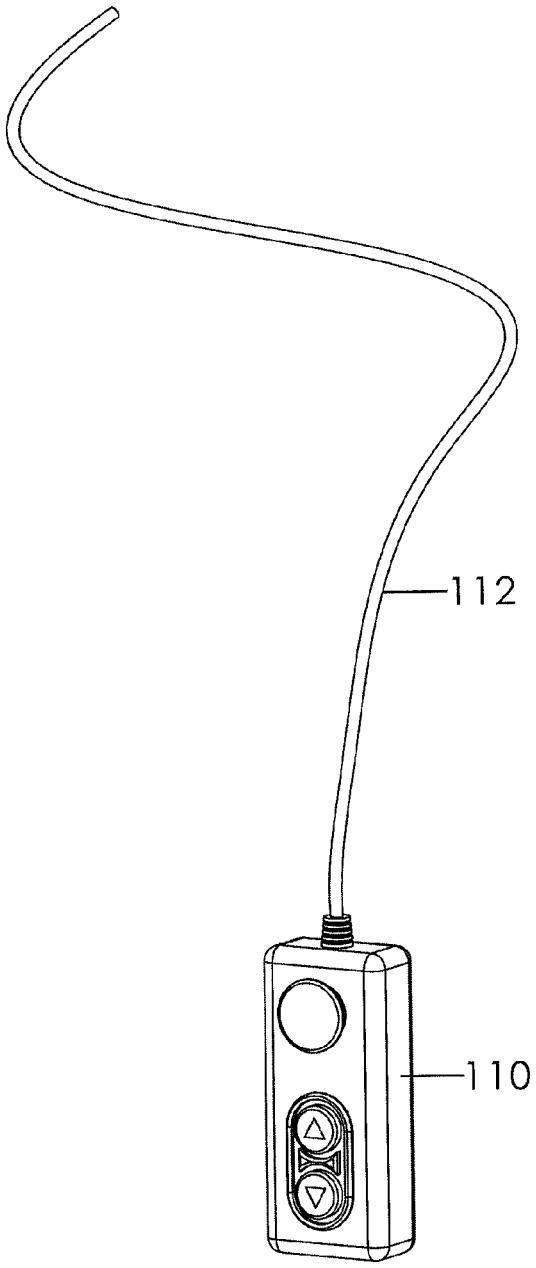
FIG. 12 is an isolated view on an enlarged scale of a controller removed from the cargo lifting apparatus of FIG. 1.

The cargo lifting apparatus 10 may include a pair of length adjustable brace member 50 although a single brace member 50 may work. Each (or a single) brace member 50 may include a first shaft telescopically received in another, said shafts defining holes into which a fastener may be inserted to maintain a desired position (FIGS. 11*a* to 11*d*). The brace member 50 includes a first end 52 (i.e. upper end) configured to be releasably coupled to a ladder rung 8, such as a clamp 54 or the like (FIG. 11*b*). The brace member 50 includes a second end 56 (i.e. lower end) configured to bear against a ground surface and may include a non-slip surface or an angle adjustable plate (FIG. 11*d*). The brace member 50 is configured to extend rearwardly and downwardly away from the ladder 2 at an angle different than the angle of the ladder 2 so as to brace and support a load on the carrier assembly 20.

Further, the cargo lifting apparatus 10 includes shields covering the upper 66 and lower 68 sprockets. More particularly, a lower shield 69 is removably coupled to a side rail 4 and configured to cover the lower sprocket 68 (FIG. 4*c*). Similarly, an upper shield 67 is removably coupled to a side rail 4 and configured to cover the upper sprocket 66 (FIG. 4*b*).

Figure 5A:
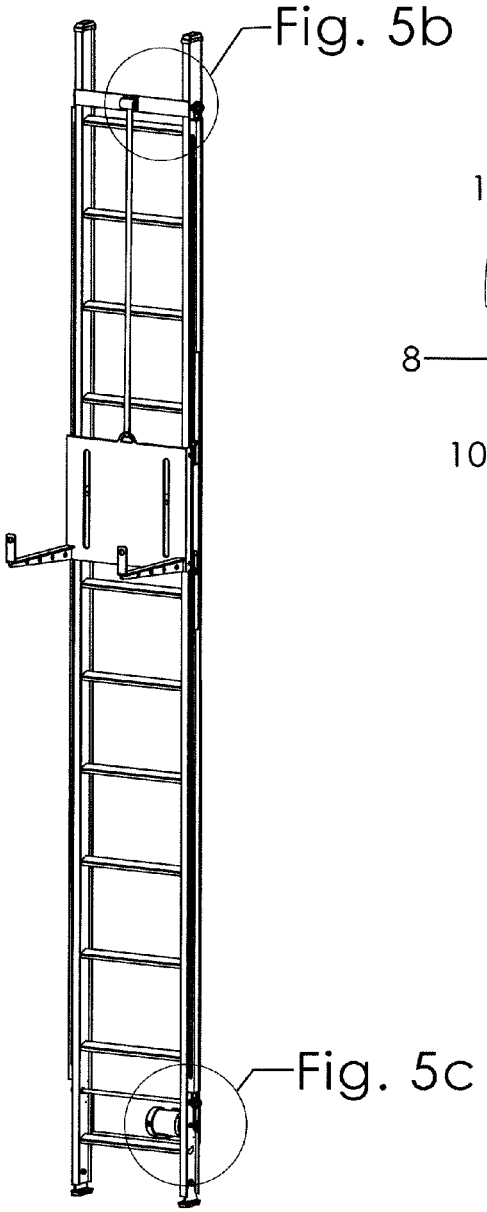
FIG. 5*a* is another perspective view of the cargo lifting apparatus as in FIG. 1.
Figure 5B:
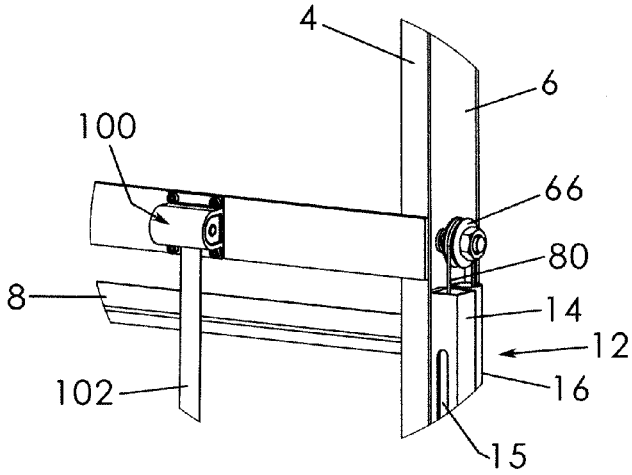
FIG. 5*b* is an isolated view on an enlarged scale taken from FIG. 5*a;*
Figure 5C:
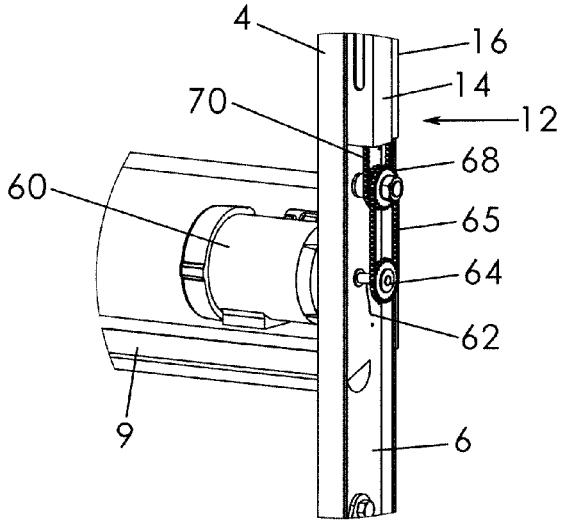
FIG. 5*c* is an isolated view on an enlarged scale taken from FIG. 5*a;*
Figure 6A:
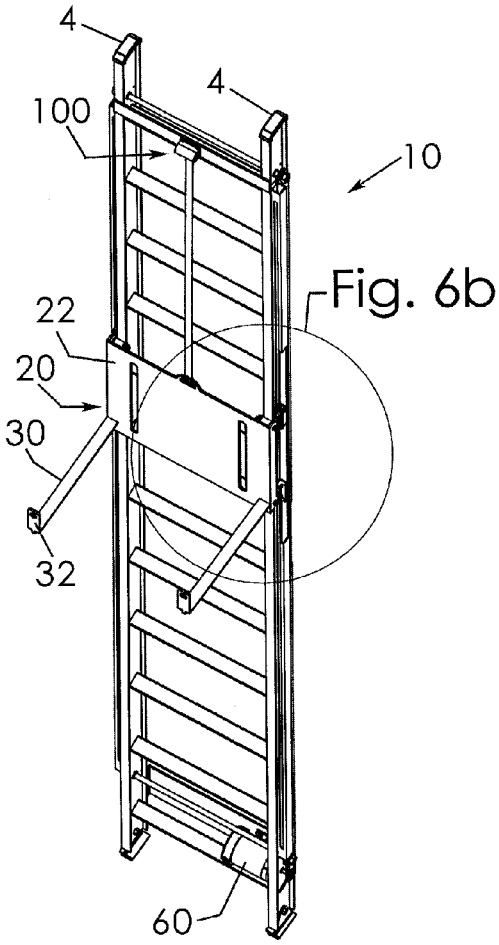
FIG. 6*a* is another perspective view of the cargo lifting apparatus as in FIG. 1.
Figure 6B:
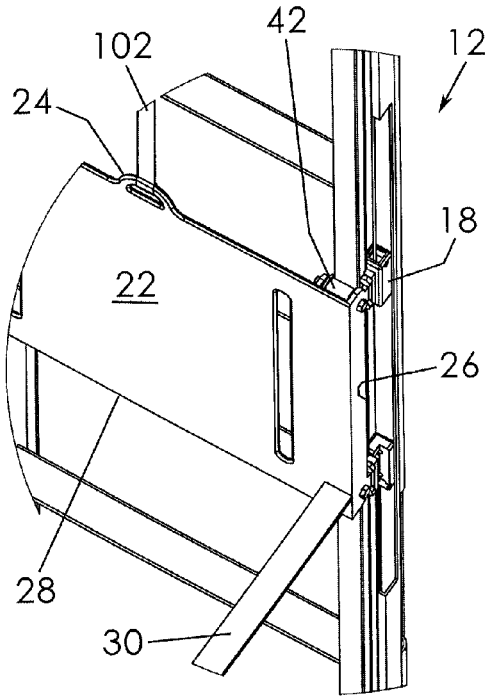
FIG. 6*b* is an isolated view on an enlarged scale taken from FIG. 6*a;*

The cargo lifting apparatus 10 includes an inertia reel 100 mounted adjacent an upper end of the ladder 2, such as being coupled to an upper rung or to its own mounting framework (FIGS. 5*a* and 5*b*). The inertia reel 100 includes a strap 102 that is movable from a retracted configuration within the reel 100 and an extended configuration extending downwardly away from the reel 100. The strap 102 includes a distal end away from the reel 100 that is coupled to a flange 24 of the carrier assembly back portion 22. The inertia reel 100 is configured to immediately halt extension of the strap 102 if extension of the strap 102 is sensed to be greater than at a predetermined speed, inertia, or velocity. In other words, the inertia reel 100 is configured to stop the carrier assembly 20 from falling should the motor/brake 60 fail to stop the downward movement thereof.

The motor/brake 60 may be in communication with a remote control 110 (also referred to herein as a controller). The controller 42 may be a handheld device that is electrically connected to the motor/brake via a data cable 112 or include a signal transmitter (not shown), in which case the motor/brake 60 includes a receiver (not shown). Preferably, the controller 42 is configured to start or stop operation of the motor/brake 60. When the motor is stopped or deactivated, the brake automatically engages to stop free wheeling movement of the motor. When deactivated, the pulley assembly 90 is not able to move and the carrier assembly 20 is safely held in position along the rails 4 of the ladder 2.

In use, the carrier assembly 20 may be loaded with cargo when it is at a lowered position on the ladder 2. The cargo may be positioned on the support members 30, the back portion 22 and support member lip 32 contributing to the stability of the load. Using the controller 42, the motor/brake 60 may be actuated, causing engagement of the pulley assembly 90 as described above. Particularly, coordinated movement of the chain 70 and cable 80 that are coupled to the guide members 18 in the first channel 14 and mounting members 40 of the carrier assembly 20, the carrier assembly 20 is urged in a desired direction. The length adjustable brace member 50 enhances the stability of the entire ladder. If the motor/brake 60 fails, the inertia reel 100 will instantly lock such that the carrier assembly 20 full of cargo will not slide downwardly out of control and potentially cause injury.

It is understood that while certain forms of this invention have been illustrated and described, it is not limited thereto except insofar as such limitations are included in the following claims and allowable functional equivalents thereof.

The invention claimed is:

1. A cargo lifting apparatus for use with a ladder having opposed parallel rails and a plurality of rungs connecting the ladder rails, said cargo lifting apparatus comprising:

a pair of lift tracks, each lift track coupled to a respective ladder rail and extending substantially between upper and lower ends of said respective ladder rail;

wherein each lift track includes first and second adjacent channels, said first channel defining a longitudinally extending slot;

at least one guide member positioned in each first channel and configured for slidable movement therein;

a carrier assembly, including:

a back portion;

at least one support member coupled to said back portion, said at least one support member configured perpendicular to said back portion and extending forwardly away from said back portion;

at least a first pair of opposed mounting members configured to be received into a respective slot of a respective first channel and coupled to a respective guide member therein, each mounting member configured to move slidably along said slot along with movement of said respective guide member;

at least a first pair of rollers coupled to said back portion and configured to bear against respective ladder rails;

a motor coupled to one of a rail or a rung of the ladder;

a pulley assembly having a cord operatively coupled to said motor and extending through one of said lift tracks and operatively coupled to said carrier assembly, said pulley assembly configured to move said carrier assembly selectively upwardly and downwardly along said rails when said motor is actuated;

an inertia reel mounted adjacent an upper end of the ladder and having an elongated strap movable between a retracted configuration about said reel and an extended configuration extending downwardly away from said reel, said strap having a distal end relative to said reel that is coupled to said carrier assembly; and wherein said inertia reel is configured to stop extension of said strap from said reel if an extension occurs at greater than a predetermined velocity.

2. The cargo lifting apparatus as in claim 1, wherein:

said pulley assembly includes a lower sprocket operatively coupled to said motor and an upper sprocket;

said cord includes a chain coupled to said lower sprocket and having a first end extending upwardly through said first channel and a second end extending upwardly through said second channel; and said cord includes a cable coupled to said upper sprocket and having a first end extending downwardly through said first channel and a second end extending downwardly through said second channel; and wherein:

said chain first end is connected to said at least one guide member;

said chain second end is connected to said cable second end; and said cable first end is connected to said at least one guide member;

said carrier assembly is selectively moved upwardly and downwardly along said rails when said motor is actuated.

3. The cargo lifting apparatus as in claim 2, wherein:

said at least one support member is a pair of support members;

said back portion of said carrier assembly is a plate having a generally planar configuration generally perpendicular to said pair of support members;

said back portion includes opposed side edges extending between opposed upper and lower edges;

said at least one pair of mounting members are attached to respective back portion side edges;

said at least one pair of rollers are attached to respective back portion side edges and are configured to bear against respective ladder rails when respective mounting members are received in respective first channel slots.

4. The cargo lifting apparatus as in claim 2, wherein said back portion of said carrier assembly includes:

a pair of opposed upstanding mounting rails;

a scissor mechanism operatively coupled between said pair of mounting rails and configured for movement between collapsed and expanded configurations;

wherein a distance between said mounting rails is increased when said scissor mechanism is moved toward said expanded configuration and is decreased when said scissor mechanism is moved toward said collapsed configuration.

5. The cargo lifting apparatus as in claim 4, wherein:

said scissor mechanism includes first and second braces each having a first end;

respective mounting rails define an adjustment slot;

said first and second brace first ends are received in respective mounting rail slots and are selectively movable therein when said scissor mechanism is moved between said collapsed and expanded configurations;

an adjustment fastener adjacent respective adjustment slots for selectively securing respective first and second braces at a selected position therein.

6. The cargo lifting apparatus as in claim 1, wherein said at least one support member defines a plurality of apertures between proximal and distal ends thereof, said plurality of apertures being configured to selectively secure cargo accessories thereto.

7. The cargo lifting apparatus as in claim 6, wherein each at least one support member includes an upstanding lip at said distal end thereof, said lip being generally parallel to and displaced from said carrier assembly back portion.

8. The cargo lifting apparatus as in claim 1, further comprising at least one length adjustable brace member having a first end configured to be releasably coupled to a rung of the ladder and an opposed second end configured to bear against a ground surface, said brace member configured to slope downwardly at an angle different than a slope of the rails of the ladder so as to support a load on said carrier assembly.

9. The cargo lifting apparatus as in claim 8, wherein said at least one length adjustable brace member is a pair of brace members separate from one another and extending away from said ladder rails and from one another so as to support a load on said carrier assembly.

10. The cargo lifting apparatus as in claim 2, further comprising:

a lower shield coupled to said side rail and configured to cover said lower sprocket; and an upper shield coupled to said side rail and configured to cover said upper sprocket.

11. The cargo lifting apparatus as in claim 2, further comprising a tensioning member interconnecting said chain second end and said cable second so as to maintain optimal engagement of said upper and lower sprockets.

12. The cargo lifting apparatus as in claim 1, further comprising:

a controller displaced from said motor and configured to selectively activate and deactivate said motor;

wherein said motor is a motor/brake combination that is configured to stop free spinning of said motor when deactivated so as to immediately halt movement of said pulley assembly and said carrier assembly.

13. The cargo lifting apparatus as in claim 5, wherein:

each said first and second channel defines an interior space, said first channel interior space being separate from said second channel interior space so as to inhibit binding of said cable extending therethrough; and said at least one guide member includes a hard plastic construction configured to reduce friction when slidably moved in said first channel.

14. The cargo lifting apparatus as in claim 3, wherein:

each said first and second channel defines an interior space, said first channel interior space being separate from said second channel interior space so as to inhibit binding of said cable extending therethrough; and said at least one guide member includes a hard plastic construction configured to reduce friction when slidably moved in said first channel.

15. The cargo lifting apparatus as in claim 5, further comprising:

a tensioning member interconnecting said chain second end and said cable second so as to maintain optimal engagement of said upper and lower sprockets.

16. The cargo lifting apparatus as in claim 3, further comprising:

a tensioning member interconnecting said chain second end and said cable second so as to maintain optimal engagement of said upper and lower sprockets.

17. The cargo lifting apparatus as in claim 3, further comprising at least one length adjustable brace member having a first end configured to be releasably coupled to a rung of the ladder and an opposed second end configured to bear against a ground surface, said brace member configured to slope downwardly at an angle different than a slope of the rails of the ladder so as to support a load on said carrier assembly.

18. The cargo lifting apparatus as in claim 5, further comprising at least one length adjustable brace member having a first end configured to be releasably coupled to a rung of the ladder and an opposed second end configured to bear against a ground surface, said brace member configured to slope downwardly at an angle different than a slope of the rails of the ladder so as to support a load on said carrier assembly.

* * * * *